US005344504A

United States Patent [19]

Deck et al.

[11] Patent Number: 5,344,504

[45] Date of Patent: Sep. 6, 1994

[54] TREATMENT FOR GALVANIZED METAL

[75] Inventors: Philip D. Deck, Ardsley; Jeffrey I. Melzer, Lansdale; William L. Harpel, Langhorne, all of Pa.

[73] Assignee: Betz Laboratories, Inc., Trevose, Pa.

[21] Appl. No.: 80,901

[22] Filed: Jun. 22, 1993

[51] Int. Cl.[5] ..... C23C 22/00

[52] U.S. Cl. ..... 148/243; 148/247; 148/251; 148/252; 148/273; 148/274; 148/279; 106/14.11; 106/14.44

[58] Field of Search ..... 106/14.11, 14.44; 148/28, 240, 243, 247, 251, 252, 273, 274, 279; 427/299, 304, 327, 328, 383.7

[56] References Cited

U.S. PATENT DOCUMENTS

| | | | |
|---|---|---|---|
| 1,710,743 | 4/1929 | Pacz | 148/273 |
| 3,297,494 | 1/1967 | Harrison | 148/262 |
| 3,444,007 | 5/1969 | Maurer et al. | 148/273 |
| 3,515,600 | 6/1970 | Jones et al. | 148/261 |
| 3,539,402 | 11/1970 | Ries | 148/247 |
| 3,539,403 | 11/1970 | Ries | 148/273 |
| 3,682,713 | 8/1972 | Ries | 148/247 |
| 3,966,502 | 6/1976 | Binns | 148/247 |
| 4,273,592 | 6/1981 | Kelly | 148/247 |
| 4,277,292 | 7/1981 | Tupper | 148/247 |
| 4,278,477 | 7/1981 | Reinhold | 148/273 |
| 4,294,627 | 10/1981 | Heyes | 148/247 |
| 4,370,177 | 1/1983 | Frelin et al. | 148/247 |
| 4,422,886 | 12/1983 | Das et al. | 148/247 |
| 5,092,924 | 3/1992 | Biggin et al. | 106/14.11 |

FOREIGN PATENT DOCUMENTS

| | | | |
|---|---|---|---|
| 0956621 | 9/1982 | U.S.S.R. | 106/14.44 |
| 85/05131 | 11/1985 | World Int. Prop. O. . | |

*Primary Examiner*—Anthony Green

*Attorney, Agent, or Firm*—Alexander D. Ricci; Steven D. Boyd

[57] ABSTRACT

An aqueous coating solution for zinc containing metals such as galvanized iron and steel. The coating solution is resistent to the formation of zinc induced sludge and can be operated with little or no overflow. The aqueous treatment solution contains from 0.1 to 10 grams per liter of a fluorometallic acid, from 0.015 to 6 grams per liter of a salt of a transition metal, from 1 to 30 grams per liter zinc; and optionally from 0.1 to 3 grams per liter a polymer of acrylic acid, methacrylic acid, or an ester thereof with a C1 to C8 alkanol.

1 Claim, No Drawings

TREATMENT FOR GALVANIZED METAL

FIELD OF THE INVENTION

The present invention relates to the treatment of metals, and more particularly to the treatment of the zinc surface of galvanized iron, galvanized steel and the like to increase corrosion resistance and increase the adhesion of siccative coatings.

BACKGROUND OF THE INVENTION

It is known to coat zinc surfaces of galvanized metals with aqueous coating solutions that are effective in providing corrosion resistant coatings which protect the surfaces of the galvanized metals from corrosive degradation. In addition to serving to prevent or inhibit corrosion, such coatings also increase the adhesion properties of the surface to siccative coatings such as paints, lacquers and the like which may be subsequently applied to the metal for decorative or other purposes.

Generally, the compositions useful for this purpose are either acidic or alkaline. Alkaline coatings are widely used, examples of such coatings are disclosed in U.S. Pat. Nos. 3,444,007; 3,515,600 and 4,278,477. Acidic compositions which form phosphate or chromate coatings on zinc, are described in U.S. Pat. No. 3,297,494. The fluorides in these coating compositions are usually in the form of complex fluorides such as $H_2ZrF_6$, $H_2TiF_6$, and $H_2SiF_6$. Such acidic coating compositions have been tried on galvanized metals but did not always function as desired. In addition, the dissolution of zinc from the surface of the metal being treated resulted in zinc contamination of the treatment bath and of the overflow from the treatment tanks. Because of the sludge producing nature of zinc solutions, the treatment tanks were overflowed in order to maintain relatively low concentrations of zinc in the treatment tanks. The presence of zinc in the overflow has given rise to concerns regarding the safe and environmentally acceptable treatment or disposal of the zinc contaminated overflow.

Patent Cooperation Treaty International Publication Number WO 85/05131 discloses an acidic aqueous coating solution to be applied to galvanized metals to increase their resistance to corrosion which contains from 0.1 to 10 grams per liter, based on fluoride content, of a fluoride-containing compound, and from 0.015 to 6 grams per liter, based on metal content, of a salt of cobalt, copper, iron, manganese, nickel, strontium, or zinc. Optionally, a sequestrant and/or a polymer of a (meth)acrylic acid or ester thereof can also be present.

SUMMARY OF THE INVENTION

The present invention provides an aqueous coating solution for zinc containing metals such as galvanized iron and steel. The coating solution of the present invention is resistant to the formation of zinc induced sludge and is also unaffected by a buildup of zinc in the treatment solution and thus can be operated with little or no overflow. The solution of the present invention provides a coating which is resistant to corrosion and promotes adhesion. The solution of the present invention is effective with high zinc concentrations thereby allowing operation with little or no bath overflow. This greatly reduces waste disposal and cleanup costs.

The aqueous treatment solution of the present invention contains:

(a) from 0.1 to 10 grams per liter, based upon fluoride, of a fluorometallic acid such as $HBF_4$, $H_2SiF_6$, $H_2TiF_6$, $H_2ZrF_6$, the ammonium or alkali metal salts thereof, hydrofluoric acid or salts thereof, or mixtures thereof;

(b) from 0.015 to 6 grams per liter based on metal of a salt of a transition metal such as nickel, cobalt, copper, iron, manganese, strontium, zinc or mixtures of two or more thereof; and (c) from 1 to 30 grams per liter of zinc; and optionally (d) from 0.1 to 3.0 grams per liter of a polymer of acrylic acid, and the esters thereof with a C1 to C8 alkanol.

With respect to (a) above, $H_2TiF_6$ is the preferred fluorometallic acid. With respect to (b) above, the preferred salts are carbonates and bicarbonates with nickel carbonate being the most preferred. With respect to item (c) above, the zinc present in the treatment solution is the result of dissolution of zinc from the material being treated with the concentration the result of limiting overflow to little or no overflow of the treatment solution tank. The pH of the treatment bath is preferably maintained between amount 4.0 and 5.0 through the addition of component (a) or other acids such as $H_2SO_4$.

With regard to component (d) above, a preferred polymer is Acumer 1510, a 25% aqueous solution of a water soluble polyacrylic acid having a molecular weight of up to about 500,000 (available from Rohm and Haas Company).

In the practice of the present invention, it is preferred to use a prepared concentrated aqueous solution of the above ingredients. This minimizes costs associated with shipping and handling. The concentrate is added to water in an amount to provide a coating solution of the desired composition and concentration. The concentrated aqueous solution contains component (a) in a concentration of at least 1 to about 15 grams per liter based on fluoride content, with the quantity of the other components, save (c) increased proportionately so that dilution with water will give the aqueous coating solution composition disclosed above. As stated above, the concentration of component (c) is the result of dissolution of zinc from the surface of the articles being treated when the bath is operated to limit overflow to little or no overflow. Although tap water can be used in preparing the concentrate in the coating solution, it is preferred to use deionized water to avoid any possible interference from undesirable ions. The concentrations can be formulated as described above, or quantities of the base such as NaOH, $NH_4OH$, $(NH_4)_2CO_3$, or $Na_2CO_3$ of an acid such as $H_2SO_4$ can be added so that upon dilution the correct pH is obtained for the coating solutions.

The coating solutions can be applied by brushing, spraying, dipping, roll coating and the like with spraying or dipping preferred. In carrying out the process of this invention the metal is preferably first cleaned, using an alkaline cleaner such as Betz Kleen ® 4010 available from Betz MetChem. The cleaned metal is then rinsed with water and sprayed with or dipped into the coating solution of the invention which is kept at 60° F. to 160° F. preferably from 110° F. to 140° F., for 1 to 300, preferably from 5 to 30 seconds. The coating materials are then rinsed with water, preferably, a final rinse such as an acidulated chrome solution (Betz Chemseal ® 750 available from Betz Laboratories) is then used. A siccative coating can thereafter be applied to the metal.

As the coating solution is used, the ingredients therein decrease in concentration and it becomes necessary to replace them, save the zinc. Because the zinc concentration is a result of dissolution of zinc from the metal being treated in the absence of or with limited overflow, zinc values in the solution will not decrease. Although it is always possible to prepare a fresh solution, this is wasteful of materials and it is also time consuming. In practice, it is desirable to use a replenishing concentrate, and the concentrates disclosed above for use in forming the aqueous coating solutions of the invention can also be used as replenishing concentrates.

The invention will become clearer from the examples which follow. The examples are given only by way of illustration and are not to be considered as limiting.

In the examples, the effectiveness of the present invention was evaluated with a variety of paint adhesion tests familiar to those skilled in the art. These tests include: "T-Bend" the tendency for paint to disadhere from a 180° bend the metal (OT equals perfect); "Cross-Hatch/Reverse Impact" (X-Hatch/Rev. Impact) the tendency of paint to disadhere from areas between closely spaced lines scribed through the paint prior to reverse impact (10=perfect rating); "Reverse Impact" the tendency of paint to disadhere from a reverse impact (10=perfect, L=paint loss, R=radial cracking, c=concentrical cracking); "Acetic Acid Salt Spray" (AASS) per ASTM-B-287 (10=perfect rating); "Natural Salt Spray" (NSS) per ASTM-D-16546 (10=perfect rating); and "Hot Humidity" (HH) per ASTM-D-2247 (10=perfect rating).

EXAMPLE 1

A bath produced from fluotitanic acid (2 g/L) and nickel carbonate (0.4 g/L) was zinc loaded by continuous application of the treatment to a zinc foil. Bath pH was maintained at about 4 by the addition of a fluotitanic acid (7.4 g/L), nickel carbonate (5.9 g/L), and sulfuric acid (53 g/L) solution. Galvanized steel panels were cleaned in an alkaline cleaner (Betz Kleen® 4010 from Betz MetChem), water rinsed, and treated by spray application with the zinc loaded nickel fluotitanate bath. The treated metal was subsequently water rinsed and given a final rinse with an acidulated chrome solution (Betz Chemseal® 750 from Betz MetChem). Treated panels were painted with a two-coat system from Valspar: epoxy primer PTY0012 and SPW0040 topcoat. Performance data (Table 1) confirm no performance deterioration to 14 g/L zinc.

TABLE 1

| ZINC (ppm) | T-BEND | X-HATCH REV. IMPACT | AASS (500 h) | NSS (1000 h) |
|---|---|---|---|---|
| 1200 | 2 | 5B | 7/10 | — |
| 2430 | 2 | 5B | 7/10 | — |
| 3910 | 2 | 5B | 7/10 | — |
| 7370 | 2 | 5B | 6/10 | — |
| 7580 | 2 | 5B | 7/10 | 7/10 |
| 8760 | 2 | 5B | 7/10 | 7/10 |
| 10600 | 2 | 5B | 7/10 | 7/10 |
| 11000 | 2 | 5B | 7/10 | 7/10 |
| 11200 | 2 | 5B | 7/10 | 7/10 |
| 13300 | 2 | 5B | 7/10 | 7/10 |
| 14200 | 2 | 5B | 7/10 | 7/10 |

EXAMPLE 2

Metal processed as in the above example at 10,600 ppm zinc was rinsed with fresh water and water contaminated at various levels with the zinc loaded treatment bath. Performance data for the Valspar paint system from Example #1 show no performance deterioration with increasing rinse contamination.

TABLE 2

| ZINC (ppm) | RINSE CONTAMINATION | T-BEND | X-HATCH REV. IMPACT | AASS (500 h) | NSS (1000 h) |
|---|---|---|---|---|---|
| 10600 | 0 | 2 | 5B | 7/10 | 7/10 |
| 10600 | 1 | 2 | 5B | 7/10 | 7/10 |
| 10600 | 5 | 2 | 5B | 7/10 | 7/10 |
| 10600 | 10 | 2 | 5B | 7/10 | 7/10 |

EXAMPLE 3

Other paints were evaluated for adhesion and corrosion resistance with galvanized steel metal treated with the solution described in Example 1, freshly prepared and loaded with zinc to 2.3 g/L.

TABLE 3

| PAINT | ZINC (ppm) | T-BEND | REVERSE IMPACT | HH (1000 h) | NSS (1000 h) |
|---|---|---|---|---|---|
| PPG epoxy/ | 0 | 4 | 6L, 7R | 10 | 7/9 |
| polyester | 2260 | 3 | 6L, 8C | 10 | 4/8 |
| PPG epoxy/ | 0 | 2 | 10 | 10 | 5/9 |
| fluopolymer | 2260 | 2 | 10 | 10 | 4/9 |
| Hanna WB/ | 0 | 1 | 10 | 10 | 4/6 |
| Trinar | 2260 | 1 | 10 | 10 | 5/6 |
| Hanna WB/ | 0 | 2 | 10 | 10 | 5/8 |
| ceram-a sil | 2260 | — | — | — | 7/8 |
| Glidden | 0 | 0 | 10 | 10 | 4/8 |
| acrylic/ | 2260 | 0 | 10 | 10 | 3/9 |
| poly-vinylidene | | | | | |

PAINTS: PPG epoxy 9018330 primer/polyester gray 9011205 topcoat; PPG epoxy 9018330 primer/fluopolymer rawhide 9016499; Hanna water-based primer 9218330/Trinar 9216411; Hanna water-based primer 9218300/ceram-a-sil 9210411; Glidden acrylic primer 9028340/polyvinylidene fluoride gray 9026255.

While the present invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

We claim:

1. A method of forming a coating on a zinc galvanized metal, said coating having increased resistance to corrosion and having good adherence to a subsequently applied siccative coating in which said zinc galvanized metal is exposed to a coating solution bath comprising from about 0.1 to above 10 grams per liter, based on fluoride, a fluorometallic acid selected from the group consisting of $HBF_4$, $H_2SiF_6$, $H_2TiF_6$, $H_2ZrF_6$, the ammonium or alkali metal salts thereof; hydrofluoric acid or salts thereof; and mixtures thereof; from about 0.015 to about 6 grams per liter, based on metal content, of a salt of cobalt, copper, iron, manganese, nickel, strontium, zinc, or mixtures thereof; and optionally, from about 0 to about 3.0 grams per liter of a polymer selected from the group consisting of polyacrylic acid, polymethacrylic acid, and C1 to C8 alkanol esters thereof; wherein the pH of the solution is from about 4.0 to about 5.0 wherein the improvement comprises limiting overflow from said coating solution bath such that the concentration of zinc in said coating solution bath ranges from about 1.0 to about 30 grams per liter.

* * * * *